United States Patent [19]

Dexter

[11] 4,083,304

[45] Apr. 11, 1978

[54] BOMB FUZE ARMING CLIP

[76] Inventor: John B. Dexter, California, Md. 20619

[21] Appl. No.: 516,852

[22] Filed: Oct. 22, 1974

[51] Int. Cl.[2] ..... F42B 25/00; F41F 5/02

[52] U.S. Cl. ..... 102/2; 89/1.5 D

[58] Field of Search ..... 102/2, 76, 81.6; 89/1.5 D, 1.812; 24/201 TR, 201 LP, 115 F, 237, 161, 159, 150 SP, 73 C, 205.19, 205.17

[56] References Cited

U.S. PATENT DOCUMENTS

| | | | |
|---|---|---|---|
| 420,811 | 2/1890 | Lewis | 24/159 |
| 510,089 | 12/1893 | Piper | 24/150 SP |
| 837,307 | 12/1906 | Koemm | 24/161 R |
| 879,232 | 2/1908 | Young et al. | 24/161 R |
| 1,745,438 | 2/1930 | Mowell | 24/161 R X |
| 2,139,665 | 12/1938 | Booker | 102/2 X |
| 2,224,161 | 12/1940 | Rice | 24/73 C |
| 2,900,691 | 8/1959 | Morgan | 24/161 R X |
| 3,625,106 | 12/1971 | Russo et al. | 89/1.5 D |
| 3,703,844 | 11/1972 | Bleikamp | 89/1.5 D |

FOREIGN PATENT DOCUMENTS

| | | | |
|---|---|---|---|
| 5,631 of | 1887 | United Kingdom | 24/159 |
| 674,441 | 6/1952 | United Kingdom | 24/161 R |

*Primary Examiner*—David H. Brown

*Attorney, Agent, or Firm*—R. Sciascia; R. Beers; S. Sheinbein

[57] ABSTRACT

A bomb fuze arming clip made of spring steel and having a substantially triangular or loop shape. A first side of the triangle extends for some distance through a hook in which the end of the third side is formed. The clip is made of spring steel. Downward force on an apex of the triangle forces the extending portion of the first side of the triangle downward through the hook, thereby opening the clip.

4 Claims, 3 Drawing Figures

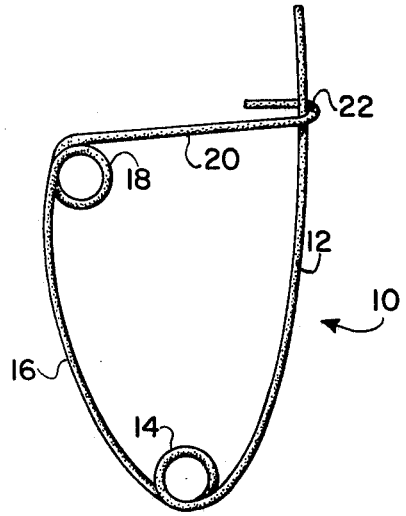
FIG. 1
FIG. 2
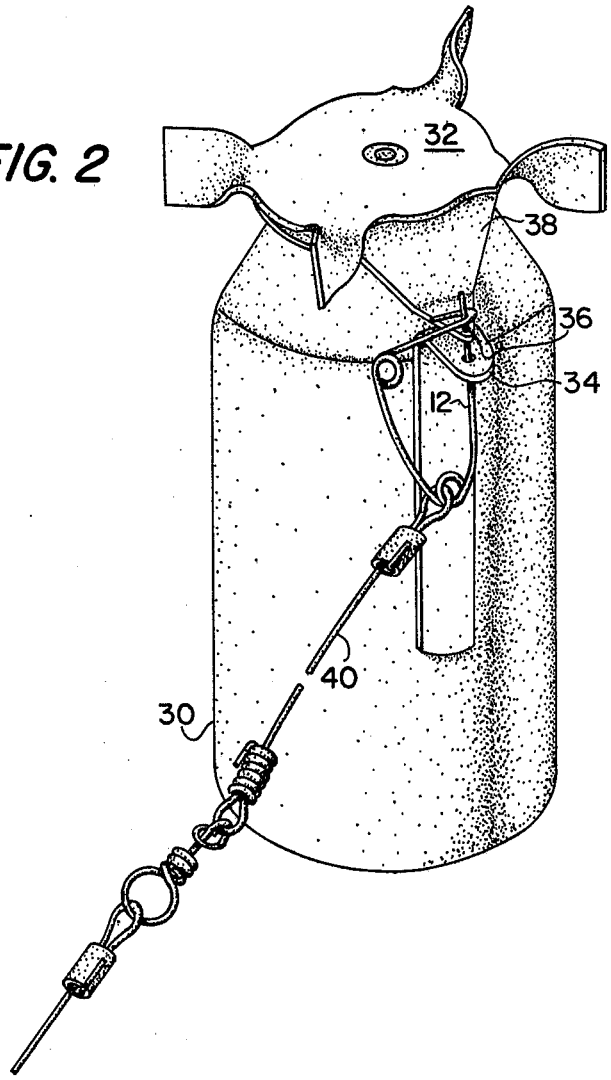
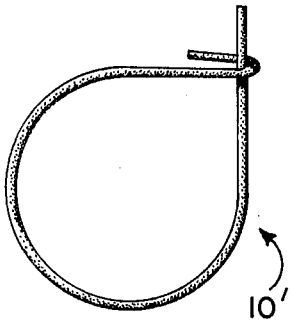
FIG. 3

BOMB FUZE ARMING CLIP

STATEMENT OF GOVERNMENT INTEREST

The invention described herein may be manufactured and used by or for the Government of the United States of America for governmental purposes without the payment of any royalities thereon or therefor.

BACKGROUND OF THE INVENTION

This invention relates to the arming of bombs and especially to a novel bomb fuze arming clip.

Bombs dropped from airplanes are frequently armed by the action of a bomb fuze in the nose of the bomb. The bomb fuze may have a propeller which is rotated by the air stream to perform one phase of the arming operation.

The propeller is prevented from turning before the bomb is dropped, one method utilizing an arming wire which is kept in place by Fahnstock clips. These clips present various problems in use, as, for example, becoming free debris when the arming wire is pulled free. As free debris, they may be sucked into the air intake of an engine and result in malfunction of the engine. Also, they are not sufficiently reliable to assure that "safe" releases in practice bomb runs do not turn into armed releases.

SUMMARY OF THE INVENTION

The objects and advantages of the present invention are accomplished by utilizing a novel clip to fasten the bomb fuze propeller to a fixed point so that it cannot rotate. The clip, which is made from a resilient material, is substantially a loop with a simple hook at one end and a substantially straight portion at the other. The hook is forced to hook around and capture the straight portion which extends past the hook for some distance.

An object of this invention is to provide an improved means for preventing the propeller of a bomb fuze from rotating until the arming wire is pulled.

Another object is to prevent the bomb fuze arming means from becoming free debris after the bomb is dropped.

A further object is to provide an improved bomb fuze arming clip which can be employed while a bomb is being shipped.

Yet another object is to provide a bomb fuze arming clip which is very simple, economical and easy to manufacture.

Other objects, advantages, and novel features of the present invention will become apparent from the following detailed description of the invention when considered in conjunction with the accompanying drawings.

BRIEF DESCRIPTION OF THE FIGURES

FIG. 1 is a schematic illustration of a first embodiment of the invention.

FIG. 2 is a schematic illustration of a bomb fuze showing the arming clip and arming wire in place.

FIG. 3 is a schematic illustration of another embodiment of the invention.

DETAILED DESCRIPTION OF THE INVENTION

FIG. 1 illustrates the bomb-fuze arming clip 10 embodying the present invention. The clip is roughly triangular in shape with a long straight portion 12, ending in a looplet 14 at the bottom, forming one side of the triangle. The second side 16 extends upward and outward from the first side to a second looplet 18. The third side 20 extends back from the second looplet 18 to the first side 12. The third side 20 is formed with a hook 22 into which the first side 12 fits to form a closed triangle. The first side 12 also has an upper portion extending above the hook 22, the function of which will be explained later.

The arming clip is fabricated from a springy material such as spring steel, for example.

The clip 10 may be employed in association with a bomb fuze 30 such as that shown in FIG. 2. The fuze 30 is placed on a bomb and when the bomb is dropped, the air velocity causes the propeller 32 to turn. This drives a rod (not shown) farther and farther down in the body of the fuze, eventually arming an explosive charge after a predetermined number of turns.

To prevent the propeller 32 from turning until the bomb is dropped, the propeller 32 is fastened in some way to an anchor 34 affixed to the body of the fuze through a lip 36 which is part of an extension 38 of the propeller 32. The lip 36 and the anchor 34 have holes drilled through them.

Previously, a Fahnstock clip (F. clip) was used to restrain the impeller, an arming wire was inserted through the holes and two or more F. clips were slipped over the arming wire to prevent its withdrawal until bomb release. Upon normal bomb release, the nose/tail arming solenoid was energized, extracting the arming wire. The F. clips were left free and sometimes were pulled into the air intake of the airplane engines.

Another problem occurred during "unarmed" releases in which the nose/tail solenoid was not energized. The F. clips are supposed to provide 15 pounds of friction force each for a total of 30 pounds when two clips are used. This friction was supposed to overcome the unenergized nose/tail arming solenoid force (9 to 12 lbs.) so that the arming wire was extracted from the solenoid instead of the fuze. Due to variations in manufacturing, tolerances, friction coefficients, etc., many intended "safe" releases became "armed" releases.

These problems do not occur with the present arming clip. The first side 12 of the clip is unhooked and inserted through the holes in the lip 36 and the anchor 34. The first side is then inserted in the hook 22, closing the triangle and preventing the impeller from rotating. An arming wire 40 is inserted through the bottom looplet 14 either before or after insertion of the clip through the holes, and is tied in any convenient manner to form a permanent attachment to the clip.

When the bomb carrying the fuze is dropped, the weight of the bomb exerts a strong force on the arming wire 40 and the bottom of the arming clip 10. This force pulls the upper portion of the front side 12 down through the hook 22. The resilience of the sides of the clip forces them apart so that the first side 12 is free of the hook 22 and the first side 12 is pulled through the holes in the lip 36 and the anchor 34. This frees the propeller 32 and permits it to begin rotating.

The force with which the clip resists opening is a function of its wire diameter but, after a wire diameter is chosen, is easily adjusted by choosing the correct length of the upper portion of the first side of the clip. Thus, the longer the upper side, the more force that has to be exerted to open the clip.

The clip is typically made from 0.63 to 0.91 inch spring steel which is heat-treated after forming.

The clip can be made with known spring constants to ensure safe jettison capability. It can be shipped inserted in the bomb fuze thereby eliminating any danger of arming the bomb during shipment.

It is apparent that the triangular shape, while convenient, is not essential. For example, FIG. 3 shows another shape for the clip, which is substantially a loop. What is essential is a loop ending in a hook at one end and ending in a substantially straight portion at the other end, the straight portion extending upwards so that it can be inserted through the hook and will extend past the hook for some distance. The loop must be resilient so that it will normally exert outward pressure to prevent the straight portion from escaping from the hook.

Obviously, many modifications and variations of the present invention are possible in light of the above teachings. It is therefore to be understood that, within the scope of the appended claims, the invention may be practiced otherwise than as specifically described.

What is claimed is:

1. A bomb fuze arming clip for preventing rotation of a bomb fuze propeller of a bomb, said bomb having an anchor attached to the side of the bomb, said propeller having a lip, comprising:

a loop of resilient material, one end being formed in the shape of a hook, the other end being straight in form extending through holes in said lip and said anchor, and extending through and beyond said hook when the loop is closed, said loop remaining closed by action of the resilient force of the loop material, outward pressure at the other side of the loop acting to pull the straight end of the loop through the hook to open the loop, the loop thereupon remaining open, the amount of said pressure required to open said loop determined by the amount of extension beyond said hook by said straight end.

2. A bomb fuze arming clip for preventing rotation of a bomb fuze propeller of a bomb, said bomb having an anchor attached to the side of the bomb, said propeller having a lip, comprising:

a loop of resilient material substantially in the form of a triangle having a first, second and third side, the second side being intermediate the other two and connected to one end of the first and one end of the third side, the free end of the third side being formed in the shape of a hook, the free end of the first side being straight extending through holes in said lip and said anchor, and extending through and beyond the hooked side when the triangle is closed, the triangle remaining closed by the resilient action of its sides, outward pressure near the end of the first side which is connected to the intermediate side acting to pull the first side through the hook in the third side to open the triangle, the triangle thereupon remaining open, the amount of said pressure required to open said triangle determined by the amount of extension beyond said hook by said first side.

3. A bomb fuze arming clip for preventing rotation of a bomb fuze propeller of a bomb, said bomb having an anchor attached to the side of the bomb, said propeller having a lip, comprising:

a loop of resilient material substantially in the form of a triangle having a first, second and third side, the second side being intermediate the other two and connected to one end of the first and one end of the third side, wherein the connections between the intermediate and the first and third sides are in the form of a looplet, the free end of the third side being formed in the shape of a hook, the free end of the first side being straight extending through holes in said lip and said anchor, and extending through and beyond the hooked side when the triangle is closed, the triangle remaining closed by the resilient action of its sides, outward pressure near the end of the first side which is connected to the intermediate side acting to pull the first side through the hook in the third side to open the triangle, the triangle thereupon remaining open, the amount of said pressure required to open said triangle determined by the amount of extension beyond said hook by said first side, and an arming wire attached to said loop at said looplet between said first and intermediate sides whereby said outward pressure is applied when said bomb is dropped.

4. A bomb fuze arming clip as in claim 3, wherein said resilient material is spring wire.

* * * * *